US008607385B2

(12) United States Patent
Isham

(10) Patent No.: US 8,607,385 B2
(45) Date of Patent: Dec. 17, 2013

(54) EXTERNAL IMMOBILIZER

(75) Inventor: John Isham, Houston, TX (US)

(73) Assignee: RadiaDyne, LLC., Houston, TX (US)

( * ) Notice: Subject to any disclaimer, the term of this patent is extended or adjusted under 35 U.S.C. 154(b) by 90 days.

(21) Appl. No.: 13/448,372

(22) Filed: Apr. 16, 2012

(65) Prior Publication Data

US 2012/0264997 A1 Oct. 18, 2012

Related U.S. Application Data

(63) Continuation-in-part of application No. 12/430,655, filed on Apr. 27, 2009, now Pat. No. 8,176,585.

(60) Provisional application No. 61/047,973, filed on Apr. 25, 2008.

(51) Int. Cl.
*A47C 27/10* (2006.01)

(52) U.S. Cl.
USPC ..... 5/621; 5/632; 5/710

(58) Field of Classification Search
USPC ..... 5/630, 632, 710, 722, 733–734, 621
See application file for complete search history.

(56) References Cited

U.S. PATENT DOCUMENTS

| | | | | |
|---|---|---|---|---|
| 4,584,730 | A | 4/1986 | Rajan | |
| 4,893,367 | A | 1/1990 | Heimreid et al. | |
| 5,279,310 | A * | 1/1994 | Hsien | 5/632 |
| 5,522,103 | A | 6/1996 | Kier et al. | |
| 5,815,862 | A * | 10/1998 | Rygiel | 5/632 |
| 5,832,550 | A | 11/1998 | Hauger et al. | |
| 6,327,724 | B1 | 12/2001 | Sharrock et al. | |
| 6,482,160 | B1 | 11/2002 | Stergiopoulos et al. | |
| 6,848,137 | B1 * | 2/2005 | Barnes | 5/710 |
| 7,213,596 | B2 * | 5/2007 | Saied | 128/845 |
| 7,216,385 | B2 | 5/2007 | Hill | |
| 7,348,974 | B2 | 3/2008 | Smith et al. | |
| 7,415,743 | B2 * | 8/2008 | Rubio | 5/722 |
| 7,453,984 | B2 | 11/2008 | Chen et al. | |
| 7,564,945 | B2 | 7/2009 | Kim | |
| 7,889,906 | B2 | 2/2011 | Smith et al. | |
| 8,135,201 | B2 | 3/2012 | Smith et al. | |
| 2002/0065461 | A1 | 5/2002 | Cosman | |
| 2011/0251489 | A1 | 10/2011 | Zhang et al. | |

FOREIGN PATENT DOCUMENTS

| | | |
|---|---|---|
| WO | WO2009142680 | 11/2009 |
| WO | WO2012007036 | 1/2012 |

* cited by examiner

*Primary Examiner* — Fredrick Conley
(74) *Attorney, Agent, or Firm* — Boulware & Valoir

(57) ABSTRACT

An external immobilizer for cancer treatment has a plurality of inflatable bladders that are independent finable depending on computer instruction based on patient position data provided from integrated or separate position determining means, such as external cameras or sensors, optionally with internal and/or external markers. In preferred embodiments, the immobilizer is fully integrated with an imaging means as well as the external beam radiation source, thus allowing both real time, independent anatomical compensation or correction for patient movement and fine control of beam shape and position to accurately target the tumor, even if the patient moves.

21 Claims, 4 Drawing Sheets

EXTERNAL IMMOBILIZER

PRIOR RELATED APPLICATIONS

The present application is a Continuation-in-Part of Ser. No. 12/430,655, filed Apr. 27, 2009, now U.S. Pat. No. 8,176,585 which claims priority to U.S. Provisional Application Ser. No. 61/047,973, filed on Apr. 25, 2008, each incorporated by reference herein in its entirety.

FEDERALLY SPONSORED RESEARCH STATEMENT

Not applicable.

REFERENCE TO MICROFICHE APPENDIX

Not applicable.

FIELD OF THE INVENTION

The present invention is related to apparatuses for immobilizing a patient during, for example, treatment of cancer or imaging scans. More particularly, the present invention relates to immobilizers having a number of sections lined with inflatable bladders, wherein the bladders can be individually controlled to achieve perfect and reproducable positioning, as well as holding the patient immobile during use. The inflatable bladders are used together with a patient imaging or position determining system that can accurately determine where the patient is in 3D space, and controls the bladders in real time in response thereto. Ideally, the system can also interface to the treatment delivery system, such as the external beam therapy source, allowing real time adjustments in patient position and/or beam shape during treatment delivery.

BACKGROUND OF THE INVENTION

Cancer is generally treated with surgery, chemotherapy, radiation therapy, or often a combination of approaches are taken. Radiation therapy (aka radiation oncology or radiotherapy), sometimes abbreviated to XRT, is the medical use of ionizing radiation, generally as part of cancer treatment to control or kill malignant cells. Historically, the three main divisions of radiation therapy are external beam radiation therapy, brachytherapy, and systemic radioisotope therapy. However, external beam radiotherapy is the most common form of radiotherapy and is popular because precise targeting of a tumor is possible.

In external beam radiotherapy, the patient sits or lies on a couch and an external source of radiation is pointed at a particular part of the body. Where the beams intersect, the radiation is highest, allowing the radiation oncologist to target the diseased tissue. Kilovoltage ("superficial") X-rays are used for treating skin cancer and superficial structures. Megavoltage ("deep") X-rays are used to treat deep-seated tumors (e.g. bladder, bowel, prostate, lung, or brain). While X-ray and electron beams are by far the most widely used sources for external beam radiotherapy, some centers employ heavier particle beams, particularly proton sources, although additional radiation sources are also possible.

Although a high level of targeting is possible, there is always some amount of radiation that passes through healthy tissue. Further, a margin of error is typically included in the treatment plan and allows a certain amount of external or internal movement, or the inevitable inaccuracies in patient positioning. Thus, a patient treated with external radiation therapy will have radiation damage due to the destruction of both healthy and cancerous tissues during external radiation treatment. Hence, it is always desirable to precisely position a patient and reduce both internal and external patient movement, thus reducing the margins and allowing for more precise targeting of the tumor.

Current methods of immobilizing patients use moldable cushions that are custom-made for each patient. These moldable cushions are a viable solution, but are less than ideal for a number of reasons. First, the cushions take up a large amount of physical space because the cushions are custom-made for each patient. Another problem with moldable cushions is that they are not effective in keeping the patient in a fixed position over multiple sessions, because the cushions allow a certain wiggle room. Thus, a patient may be in a slightly different position in one session than another, which can cause great difficulties in the treatment with external beam therapy.

Furthermore, such systems are static, and cannot be manipulated during therapy as the patients anatomy and/or position changes. The moldable cushions do not account for weight gain or loss between treatment sessions, nor do they accommodate the natural movements of respiration.

Thus, a need has arisen for a patient immobilizing apparatus that has the ability to fix a patient in the same location over multiple sessions of treatment regardless of weight changes or patient movement.

Various patents have issued relating to patient immobilizers. U.S. Pat. No. 5,832,550, for example, discloses a moldable vacuum cushion for positioning a patient during radiation therapy treatment that includes an indexing bar with indexing pins to allow the attached cushion to be quickly, easily, accurately, and repeatably indexed on a baseplate or treatment table. The indexing bar may be releasably mounted on a frame member fixed to the cushion or may be directly mounted on the cushion. This is a simple mechanical system, and does not allow automated movement compensation.

U.S. Pat. No. 7,216,385 discloses an inflatable cushion for use in a system and method in supporting the knees and legs of a person during surgery that includes an inflatable bladder. A bladder port communicates with a source of inflating fluid. The system includes the source of pressurized fluid and a valve assembly to switchably control the inflation and deflation of the bladder. The bladder may have a removable cover extending around the bladder, and the bladder may have side pleats to assist in expanding with the cover having corresponding accordion folds. The method involves placing a patient on a surgical table, decompressing the patient's spine to a flat back/drop knee position, interposing the bladder between the table and the patient's knees and advancing the knees to a full prone position by inflating the bladder. While a useful first step in designing a effective immobilizer, this device in not a full-body, dedicated immobilizer, and does not automatically detect and compensate for patent movement. In effect, it is little more than an inflatable pillow with foot operable valve actuators and having limited functionality.

U.S. Pat. No. 4,893,367 discloses a system of separately adjustable pillows that is characterized by separately inflatable and deflatable containers, which may be emptied or filled from a connected source with a pressurized fluid, via a manifold provided with valves for each container. However, as above, no automated inflation or motion compensation is possible, nor communication with treatment devices, and the device is no more than a collection of inflatable pillows.

U.S. Pat. No. 6,327,724 discloses an inflatable positioning device that includes a pump, a tube extending from the pump, a valve intermediate the length of the tube and a non-rectangular inflatable pillow connected to the end of the tube remote from the pump. The non-rectangular inflatable pillow is dimensioned for positioning portions of a patient's body during surgery. As above, no automated movement compensation is possible.

There are available on the market several systems that offer image guided radiation therapy. For example, the Trilogy® Stereotactic System combines an X-ray imager with an optical guidance system using infrared cameras and a "respiratory gating" technology that coordinates treatment with respiration, to compensate for tumor motion due to the patient's breathing. However, an ideal system would compensate for patient movements, by adapting to the changes in a patient position in a way as to reduce the amount of beam off time, thus allowing the treatment to be completed in a much shorter time.

As noted, none of the above described art provides a fully satisfactory solution to the patient immobilization problem, and there is room for considerable improvement in the art. The ideal system will allow automatic, precise compensation for both interfraction motion (changes in position caused by day-to day set-up conditions) and intrafraction motion (changes in position during a treatment session because of normal respiratory and organ motion).

BRIEF SUMMARY OF THE INVENTION

Generally speaking, the invention is a patient immobilizer comprising a couch having a base with a plurality of inflatable bladders coupled to a fluid/gas source and computer activated valve means for selectively inflating the bladders and thus providing initial patient immobilization during simultaneous treatment planning, as well as adjust for anatomical changes and patient during treatment delivery. In preferred embodiments, the base is contoured to fit a patient's body. Also preferred, the base is combined with sidewalls, also having inflatable bladders, to control lateral motion.

The device can be used with any external beam therapy or other treatment where patient positioning is important, including intensity-modulated radiation therapy (IMRT), image guided radiotherapy (IGRT), three-dimensional (3D) IGRT, stereotactic radiation therapy (SRT), 3-dimensional conformal radiation therapy (3DCRT), and the like.

In another embodiment, the invention is a patient immobilizer comprising a couch or bed having a base and two side walls, the base having molded contours to fit a patient's body and a plurality of inflatable bladders on the side walls and base. Each of the inflatable bladders is connected via lines to a fluid source (usually air or water), and each line has an independently actuatable valve controlled by a processor, which accepts position data and actuates the valves based on this data so as to independently inflate or deflate one or more of said inflatable bladders, thus compensating for a patient's movement in near real time. The couch can include one or more pumps for active inflation or deflation of said inflatable bladders, but these can be optional depending on fluid source pressure and valve size.

The system that collects and provides the position data can be separate or an integrated part of this system, and the position data can be external or internal (preferably both) to the patient's body. The position data can be raw data or already collated to provide a 2D or 3D map of the patient, depending on how fully integrated the system is. Thus, when we refer to "3D imaging data" or "3D position data" and the like herein we mean to include both the raw and the processed data.

A variety of markers on the skin surface and/or internal markers, such as fiducial markers, motion sensors on balloons or other implantable instruments, radioactive seeds implanted in a tissue, and the like, can also be used to provide patient positional data. Markers include electromagnetic, infrared, heavy metals, carbon, reflective markers, radiolabels, fluorescent labels, and the like, depending on the sensor system used to detect same. Thus, the real time feedback needed to allow selective inflation/deflation of the couch bladders can be provided in a variety of different ways and combinations thereof. For example, 3D optical data can be combined with internal data about actual target location via radioactive seed, fiducial markers, and the like.

Preferably, the imaging system comprises two or three offset cameras for collecting said patient imaging data and triangulating same to provide a 3D model of the patient. The imaging system is also preferably non-invasive, using e.g., light, IR, ultrasound, electromagnetic radiation, or radar to provide the image data.

In preferred embodiments, the couch has head, torso, pelvic, thigh, calf and foot sections, each of said sections having at least one inflatable bladder on said base and at least one inflatable bladder on each of said side walls. However, it is also possible to provide a couch wherein one or more sections and/or bladders are omitted, depending on the medical specialty at issue.

In further preferred embodiments the side bladders are large enough to compensate for a variety of patient sizes, squeezing the patient between a pair of bladders at each section. Other size adjustments are possible, including a position adjustable neck pillow in said head section so as to accommodate patient's height. Raised thigh and calf sections are angled so as to raise a patient's knees, preferably also adjustable. Overall length can also be adjustable, e.g. by means of telescoping components, threaded screw mechanisms, spring button pins and holes on slidable tubes, and the like.

In other embodiments, the side walls and side bladders are optional, again depending on the medical specialty at issue and cost considerations. It may also be possible to have side walls only at one or more critical points, e.g., the hips, depending on the treatment target area.

The invention also provides methods of irradiating a patient with external beam therapy, said method comprising positioning a patient on the patient immobilizer, compensating for a patient's movement in near real time (using the imaging system, software and inflatable bladders), and irradiating said patient as dictated by the treatment plan. The couch can be used with any type of radiation therapy, or for any other treatment methods that require patient immobilization.

In other embodiments, the invention is an external immobilizer for use in cancer treatment having a foot section having at least one inflatable bladder therein, a knee section connected to an end of the foot section, a pelvic section connected to an end of the knee section opposite the foot section, and an inflating means cooperative with the foot section and the pelvic section. The inflating means selectively inflates the bladders of the foot section and the pelvic section. The knee section has an elevated surface thereon. The pelvic section has at least one inflatable bladder cooperative with a surface thereof. The pelvic section has a buttocks section having at least one inflatable bladder cooperative with a surface thereof and, a lower back section having at least one inflatable bladder cooperative with a surface thereof The external immobilizer can have a torso section connected to an end of the pelvic section opposite the knee section. The torso section has at least one inflatable bladder cooperative with a surface thereof. The foot section has a molded contour therein suitable for receiving the feet of a patient. The inflatable bladder of the foot section has a first inflatable bladder and a second inflatable bladder.

The knee section of the present invention has a first inclined surface and a second inclined surface extending toward an upper section thereof. Additionally, the knee section has molded contours therein suitable for receiving the legs of a patient. The pelvic section has molded contours therein suitable for receiving the buttocks and lower back of a patient. These molded contours are selectively inflatable by the inflating means so as to position the buttocks and lower back of a patient.

The inflating means has a plurality of actuating devices connected to the inflatable bladders of the foot section and the pelvic section, a plurality of fluid lines connected to the plurality of actuating devices, and a fluid supply device connected to the plurality of fluid lines at an end remote from the plurality of actuating devices. A computing means is connected to the plurality of actuating devices for actuating the actuating devices so as to selectively and independently inflate and deflate the inflatable bladders using a fluid supplied by the fluid supply device.

The present invention is also an external immobilizer for cancer treatment having a mat structure with contoured moldings formed therein, a plurality of bladders positioned on the mat structure adjacent the contoured moldings, a plurality of actuating devices connected to the plurality of bladders, a plurality of fluid supply lines connected to the actuating devices, and a fluid supplying means connected to the plurality of fluid supply lines remote from the plurality of actuating devices. The fluid supplying means selectively supplies fluid to the plurality of inflatable bladders. The mat structure has a foot section, a knee section connected to the foot section, and a body section connected to an end of the knee section opposite the foot section. The body section has a buttocks section, a lower back section connected to an end of the buttocks section, and a torso section connected to an end of the lower back section opposite the buttocks section. At least one of the plurality of bladders is inflatable so as to lock the feet of a patient within the foot section.

The present invention is also a method of immobilizing a patient for cancer treatment. The method requires placing a patient on the mat or couch structure, and selectively inflating the plurality of inflatable bladders, based on patient imaging data provided to the software controlling the actuating valves, so as to fix the patient in a desired position. The inflation and deflation of the plurality of inflatable bladders positioned below the torso may be coordinated so as to compensate for the heave of the chest of the patient caused by breathing. A patient's weigh gain or loss may be compensated for during subsequent treatments by inflating the plurality of inflatable bladders to a greater or lesser degree.

DETAILED DESCRIPTION OF THE INVENTION

Figure 1:
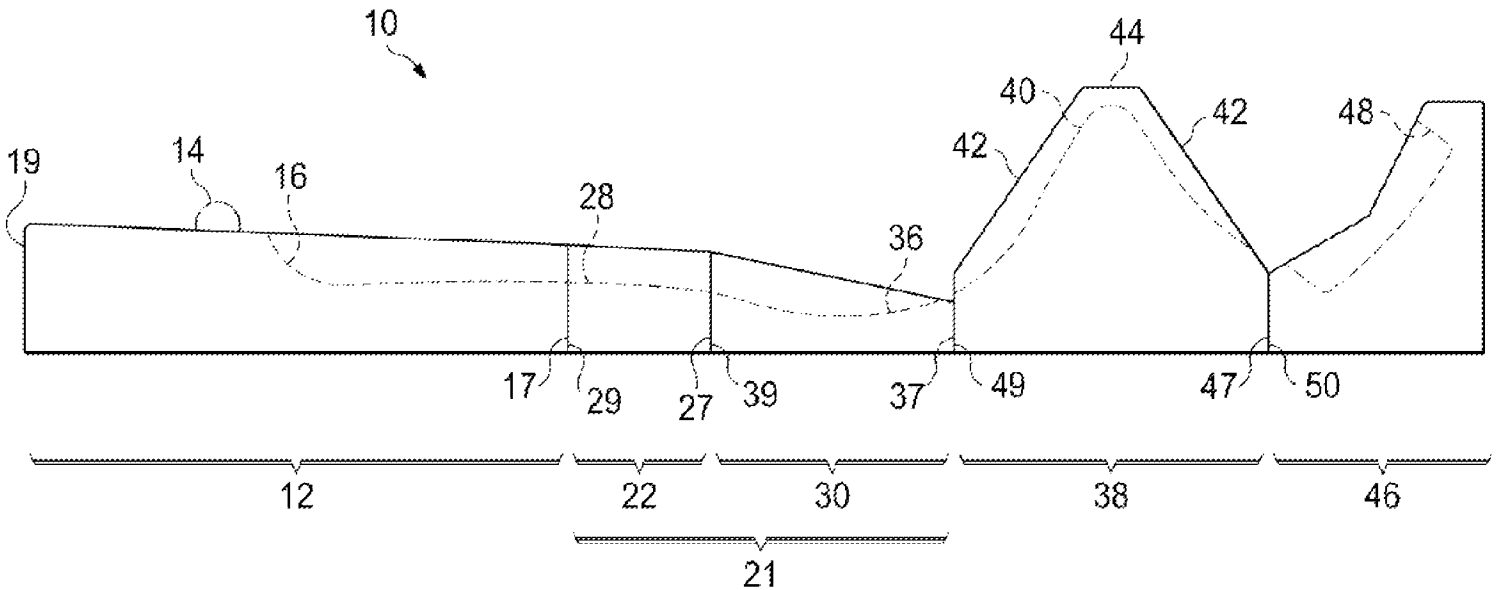
FIG. 1 shows a side elevation view of the external immobilizer of the present invention.

Referring to FIG. 1, there is shown the side elevation view of the external immobilizer 10 of the present invention. The foot section 46 has an end 50 connected to an end 47 of the knee section 38. The knee section 38 has an opposite end 49 connected to an end 37 of the buttocks section 30. The buttocks section 30 has an opposite end 39 connected to an end 27 of the lower back section 22. The lower back section 22 has an opposite end 29 connected to an end 17 of the torso section 12. Together, the buttocks section 30 and the lower back section 22 for the pelvic section 21.

The torso section 12 has a neck support 14 and an upper torso molding 16. The upper torso molding 16 is shown with dotted lines. The lower back section 22 has a lower torso molding 28. The lower torso molding 28 is shown with dotted lines. The buttocks section 30 has a buttocks molding 36. The buttocks molding 36 is shown with dotted lines. The knee section 38 has a leg molding 40. The leg molding 40 is shown with dotted lines. The knee section 38 has angled sides 42 that angle towards a plateau 44 where the knees of the patient rest. The foot section 46 has a foot molding 48. The foot molding 48 is shown with dotted lines.

As can be seen in FIG. 1, the torso section 12 angles downwardly from the opposite end 19 to the end 17. Likewise, the lower back section 22 angles downwardly from the opposite end 29 to the end 27. The buttocks section 30 also angles downwardly from the opposite end 39 to the end 37. Notably, the buttocks section 30 has a downward angle greater than the downward angle of the lower back section 22 and the torso section 12.

In the external immobilizer 10 of the present invention, a patient lies on his or her back so that the back side of his or her body is adjacent to the sections 12, 22, 30, 38, and 46 of the external immobilizer 10.

Figure 2:
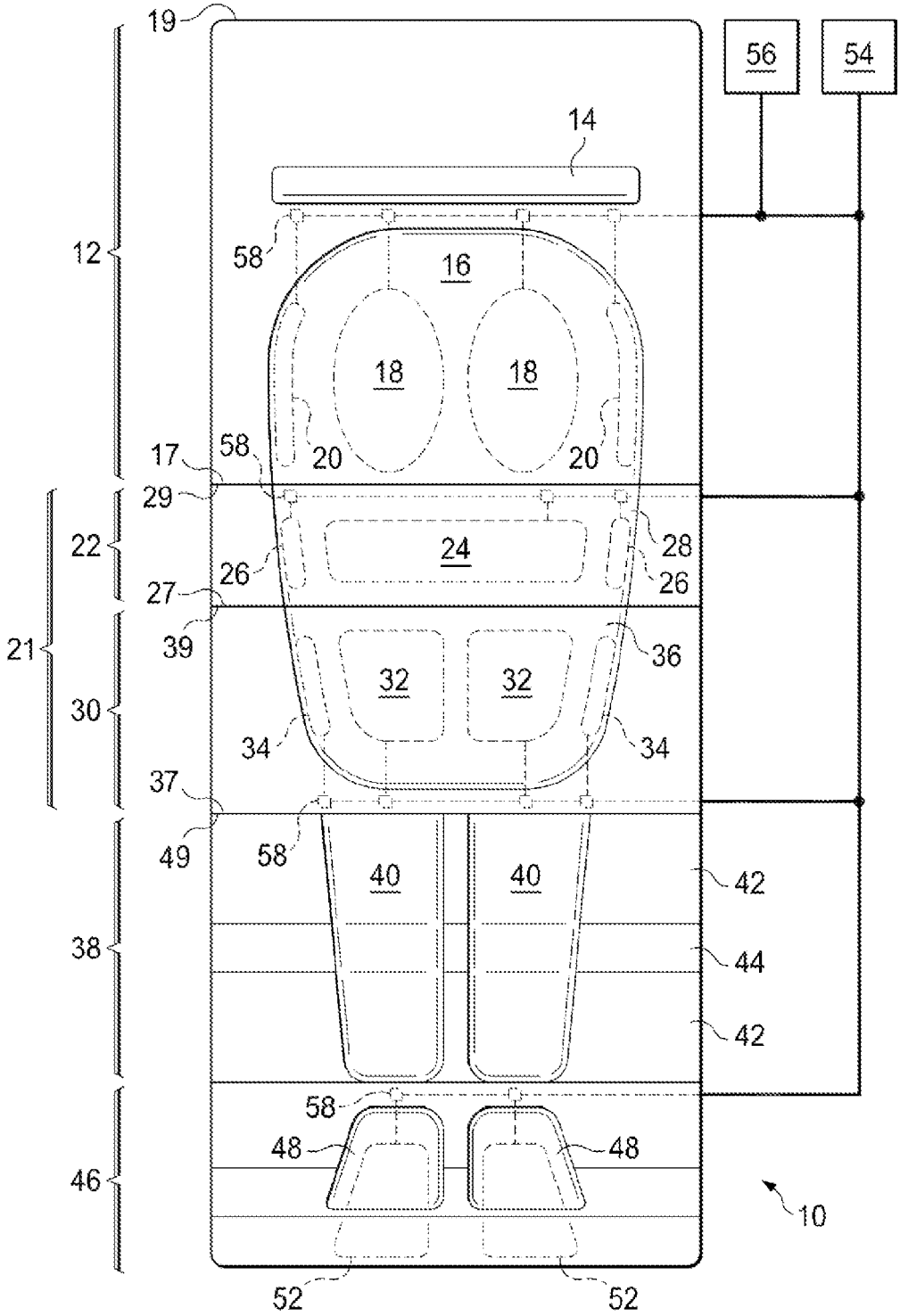
FIG. 2 shows a plan view of the external immobilizer of the present invention.

Referring to FIG. 2, there is shown a plan view of the external immobilizer 10 of the present invention. The torso section 12 has a neck support 14 and a upper torso molding 16. Inflatable bladders 18 and 20 are located in the upper torso molding 16. The bottom bladders 18 lie directly under the upper torso molding 16, and thus, they lie directly under the back of a patient. The side bladders 20 lie on the sides of the upper torso molding 16. The bottom bladders 18 inflate and deflate so as to move the patient up and down within the upper torso molding 16. The side bladders 20 inflate and deflate so as to move the patient from side to side and up and down. The inflation and deflation of the bladders 18 and 20 is controlled by a computer 56. The computer is electronically connected to actuating devices 58, which are actuated so as to allow a fluid to pass into and out of the bladders 18 and 20. A fluid is supplied by a fluid supply device 54.

The lower back section 22 has a lower torso molding 28. Under the torso molding 28 is a bottom bladder 24. On the sides of the lower torso molding 28 are side bladders 26. The bladders 24 and 26 are connected to actuating devices 58 that allow fluid to be supplied or withdrawn from the bladders by the fluid supply device 54. The actuating devices 58 are electronically connected to the computer 56, which electronically actuates the devices 58. The bladders 24 and 26 of the lower back section 22 can be inflated and deflated independently.

The buttocks section 30 has a buttocks molding 36. Under the buttocks molding 36 are bottom bladders 32. On the sides of the buttocks molding 36 are side bladders 34. The bladders 32 and 34 are connected to the actuating devices 58. Fluid is supplied to and from the bladders 32 and 34 by the fluid supply device 54. The actuating devices 58 are electronically connected to the computer 56, which controls the inflation and deflation of the bladders 32 and 34. The bottom bladders 32 can move a patient upwards and downwards within the molding 36. The side bladders 34 can move the patient up and down and sideways within the molding 36.

The knee section 38 has a leg molding 40 for each leg of the patient. The leg molding 40 travels up and down the angled side walls 42 of the knee section 38. The knees of the patient rest on the plateau 44 of the knee section 38.

The foot section 46 has a foot molding 48 for each of the feet of the patient. Inflatable and deflatable bladders 52 are located under the molding 48. The bladders 52 are connected to the actuating devices 58. The bladders are inflated and deflated by a fluid supply device 54. The actuating devices 58 are actuated by the computer 56.

The fluid supply lines and electronic lines that are connected between the fluid supply device 54 and the bladders 18, 20, 24, 26, 32, 34, and 52 and between computer 56 and actuating device 58, respectively, are shown as dotted lines in FIG. 2. Each of the bladders 18, 20, 24, 26, 32, 34, and 52 can be inflated or deflated independently of the other so as to position the patient in a certain position for cancer treatment.

The bladders 18, 20, 24, 26, 32, 34 and 52 of the external immobilizer 10 of the present invention can all inflate or deflate independently so as to pinpoint a position of a patient. The bladders 18, 20, 24, 26, 32, 34 and 52 thus can precisely position a patient in successive treatment sessions for cancer regardless of weight gain or weight loss of the patient. If weight has been gained in the thighs of a patient, the bladders 32 and 34 of the buttocks section 30 can be inflated and deflated so as to precisely position the femoral parts of the patient's body so as to create the same position of the patient as the previous treatment session.

Another unique aspect of the external immobilizer is the bladders 18 and 20 of the torso section 12. Patients must continuously breathe during cancer treatment, even external beam treatment. If treatment is in a region near the lungs, then fixing the position of the patient will be more difficult because the patient's body will continuously move up and down when the patient breathes. The present invention contemplates that the bladders 18 and 20 of the torso section 12 can be controllably inflated and deflated to compensate for the breathing of a patient during treatment. Thus, the bladders 18 and 20 are continuously inflated and deflated when the patient breathes in and out so as to keep the body of the patient in a constant position while the patient breathes during cancer treatment.

Another unique aspect of the present invention is that the bladders 18, 20, 24, 26, 32, 34 and 52 can be inflated and deflated so as to position the patient at an angle that would otherwise not be reachable by a treatment machine that is in the hospital. Thus, the present invention provides cancer treatment to a greater number of patients that would otherwise not be able to receive such treatment because a machine that would not be otherwise to reach a certain area of the body can now reach that area because the external immobilizer can position the patient in such a position.

Figure 3:
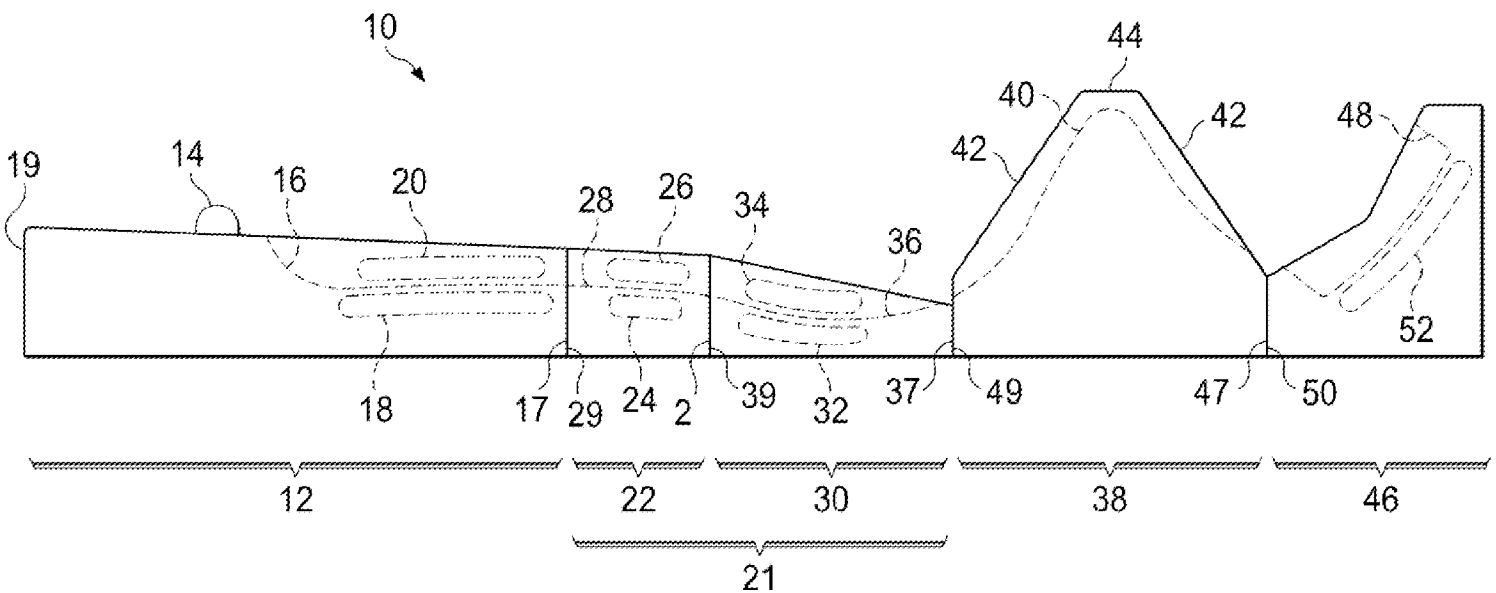
FIG. 3 shows a side cross-sectional view of the external immobilizer of the present invention.

Referring to FIG. 3, there is shown a side cross-sectional view of the external immobilizer 10 of the present invention. The bottom bladder 18 of the torso section 12 is located below the upper torso molding 16. The side bladder 20 of the torso section 12 is located on the side of the upper torso molding 16. Thus, the bottom bladder 18 is located below the side bladder 20. Similarly, the bottom bladder 24 of the lower back section 22 is located below the lower torso molding 28. The side bladder 26 is located on the side of the lower torso molding 28. Thus, the bottom bladder 24 is located below the side bladder 26. Similarly still, the bottom bladder 32 of the buttocks section 30 is located under the buttocks molding 36. The side bladder 34 is located on the side of the buttocks molding 36. Thus, the bottom bladder 32 is located below the side bladder 30. The bladder 52 is located under the foot molding 48 of the foot section 46.

The present invention is also a method of immobilizing a patient for cancer treatment. A mat structure is made which has contoured moldings formed therein and a plurality of inflatable bladders under the surface of the contoured moldings. Each of the inflatable bladders has an actuating device connected thereto. The actuating devices are connected through fluid supply lines to a fluid supply device, as well as to a processor that controls the valves. A patient is placed on the mat structure and the inflatable bladders are selectively inflated so as to fix the patient in the desired position. The actuating devices and the fluid supply device are connected to a computer, which controls the inflation of the bladders based on patient positioning data.

The system is designed to be used with existing or dedicated patient imaging systems that can accurately determine a patient's position. Once the position is known, software computes which bladders should be inflated or deflated, and how much, and thus movement compensation occurs in near real time. This is shown in FIG. 4.

Figure 4:
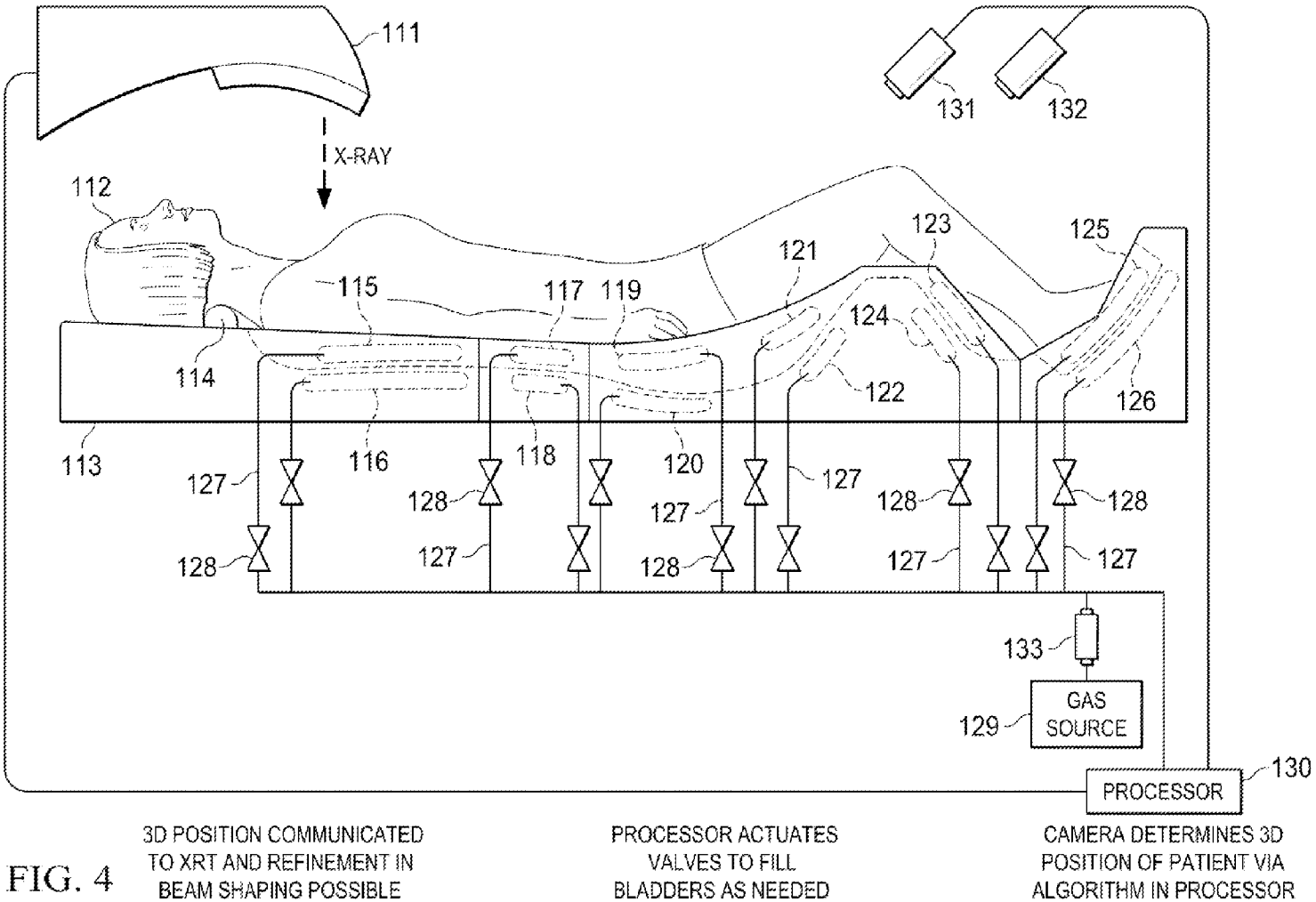
FIG. 4 is a side view of the entire system with patient shown using the immobilizer, imaging system, and XRT.

In FIG. 4, the radiation beam device 111 is shown positioned over the patient 112 who is lying on the immobilizer 113. Headrest 114, and inflatable bladders 115, 116, 177, 118, 119, 120, 121, 122, 123, 124, 125, and 126 are connected via lines 127 having valves 128 to fluid/gas source 129. In this embodiment, additional pillows 121, 122 support and position the thighs, 123, 124 the calves, and 125, 126 the feet, although these bladders may be optional per the prior embodiments.

Headrest 114 or a pair of pillows 114 can also be connected to lines 127 (not shown) and control head positioning, however, it may be preferred to have headrest 114 not connected to lines and movable up and down said couch so that patients of differing heights can be accommodated. As an alternative, 114 can be connected to lines, and a certain amount of repositioning available through mechanical means (e.g., moved back and forth along a slot in the base). Likewise, the knee (thigh/calf) section can be mechanically adjusted to accommodate leg length, and also knee height.

Actuatable valves 128 control flow from the fluid source 129 and are automatically actuated according to instructions from processor 130. A pair of cameras 131, 132 visual the patient and by triangulation create a 3D image of the patient in real time. This can be done with or without fiducial markers placed on the patient, as some modern systems no longer need a marker, such as tungsten, titanium, carbon, reflective surface, etc. As the patient moves, the software instructs the valves to open and thus compensate for real time patient movements.

In preferred embodiments, the fluid control is two way, so that fluid can actively be removed from the bladders and well as put in, and thus a two way pump 133 functions for inflation and deflation. In another embodiment, inflation can occur via pressure from the fluid source, and deflation due to patient weight coupled with a sufficiently large valve opening, and thus pump 133 may be omitted. In addition, the software can communicate with the XRT source 111, allowing real time beam shaping and thus allowing highly accurate targeting of the tumor.

Imaging systems such as described above are already commercially available. One preferred system is provided by Vision RT. Vision RT's imaging technology employs stereo vision techniques in the same way as the human visual system perceives depth in 3D. By viewing an object through two eyes (cameras) from different perspectives, the brain is able to derive depth information of a scene from the disparity between the two retinal images. Computer vision algorithms are able to adopt this approach in order to derive 3D surface information of an object. To accomplish this, the positions, orientations, and optical properties of two different cameras viewing the same object, must be computed. This is achieved through a process known as camera calibration. This involves imaging an object on which a precise pattern has been produced, the dimensions of which are known.

The calibration process then derives the orientation, position, and optical properties for each respective camera, with respect to a known reference point. Once the two cameras are calibrated, sets of corresponding 2D points may be determined between the images acquired from both cameras. Through a process known as triangulation, the actual 3D position of each set of corresponding points may be computed. See e.g., U.S. Pat. Nos. 7,348,974, 7,889,906, and 8,135,201 for more detail.

Another imaging system is C-RAD Sentinel™, a laser based optical surface scanning system that monitors the patient for motion during treatment. The system checks the patient's position more than once every second with sub-millimeter accuracy. Being completely non-invasive, no markers need to be placed on the patient or the couch. Deviation outside of set tolerances are indicated by an audible and visual alarm, and the practitioner halts treatment and adjust the patient and/or couch. With the 4DCT option, a Sentinel™ system installed in the CT room can also be usable as a respiratory gating device for prospectively gated as well as retrospectively gated imaging (aka 4DCT) on modern oncology CTs. The respiratory motion is measured optically on the patient's skin, without requiring any markers or other equipment to be placed on the patient. Two detection points can be selected which enables both thoracic and abdominal breathing motion to be detected in parallel. This system would be particularly beneficial for combination with the couch of the invention as it is noninvasive, and the use of visual data to adjust patient position will obviate the need for gating algorithms, as the inventive couch will automatically compensate for respiratory movements.

Another imaging system is provided by Varian. The Varian® On-Board Imager® (OBI), standard on the Trilogy™ linear accelerator, identifies the patient's position at the time of treatment, and allows remote compensation for same (e.g., with the positioning couch of the invention). A choice of imaging modalities is available on the system, including 2D radiographic, fluoroscopic, or 3D cone-beam CT imaging. The use of kV imaging can result in lower patient dose and better image quality than megavoltage imaging. However, this imaging modality is invasive, subjecting the patient to more radiation.

Eleckta also has patient imaging products. The Elekta Axesse™, for example, is an Image Guided Stereotactic Treatment Management System, which uses low-dose X-ray volume imaging (XVI) technology, and thus also subjects the patient to additional radiation. However, the system allows true three-dimensional (3D) image guidance at the time of treatment with highly conformal beam shaping and robotic 6D sub-millimeter patient positioning to deliver fast, efficient and accurate treatment. All treatment processes from planning to delivery are controlled from a single workstation supported by an electronic medical record (EMR) centered workflow. This system might be ideal if combined with non-invasive imaging modalities, as described above.

Thus, the positioning couch of the invention is intended to be combined with any similar imaging guidance systems, allowing for automated couch adjustments to compensate for larger patient movements, and also in some embodiments allowing fine control over beam shape to further refine the treatment targeting. Such systems are available, as described in U.S. Pat. No. 7,453,984. Further, although we have described image guidance and radiation treatment as separate components, they can of course be combined. See e.g., U.S. Pat. No. 7,564,945. However, the Vision RT C-RAD Sentinel® are non-invasive systems that do not require the use of any markers and adds no further irradiation the patient. Thus, systems such as these are preferred. See also, (US20110251489 & U.S. Pat. No. 6,482,160 describing non-invasive ultrasound imaging).

The foregoing disclosure and description of the invention is illustrative and explanatory thereof. Various changes in the details of the described system and method can be made within the scope of the appended claims without departing from the true spirit of the invention. The present invention should only be limited by the following claims and their legal equivalents.

The following references are each incorporated by reference in its entirety.

U.S. Pat. No. 4893367
U.S. Pat. No. 5832550
U.S. Pat. No. 6327724
U.S. Pat. No. 6482160
U.S. Pat. No. 7216385
U.S. Pat. No. 7348974
U.S. Pat. No. 7453984
U.S. Pat. No. 7564945
U.S. Pat. No. 7889906
U.S. Pat. No. 8135201
US20110251489
WO2012007036
WO2009142680
US2002065461

The invention claimed is:

1. A patient immobilizer comprising:

a) a couch having a base and two side walls,
   i) said base having molded contours to fit a patients body and one or more inflatable bladders thereon;
   ii) each of said side walls having one or more inflatable bladders thereon;
   iii) each of said inflatable bladders connected via lines to a fluid source;
   iv) each of said lines having an independently actuatable valve;

b) a separate or integrated system for providing patient position data; and c) a processor for accepting said patient position data and for actuating said valves based on said patient position data so as to independently inflate or deflate one or more of said inflatable bladders, thus compensating for a patient's movement in near real time.

2. The patient immobilizer of claim 1, further comprising one or more pumps for active inflation or deflation of said inflatable bladders.

3. The patient immobilizer of claim 1, wherein patient position data is provided by an internal motion sensor and/or fiducial markers on a balloon.

4. The patient immobilizer of claim 1, wherein said couch is comprised of pelvic, leg and foot sections, each section having at least one inflatable bladder.

5. The patient immobilizer of claim 1, wherein said patient position data is provided by monitoring of target tissues using internal markers.

6. The patient immobilizer of claim 1, wherein said patient position data is provided by external imaging.

7. The patient immobilizer of claim 1, wherein said patient position data is provided by external imaging and by monitoring of target tissues using internal markers.

8. The patient immobilizer of claim 1, wherein patient position data is 3D patient image data provided by an imaging system and internal fiducial markers.

9. The patient immobilizer of claim 1, wherein said patient position data is 3D patient image data provided by an imaging system.

10. The patient immobilizer of claim 9, wherein said imaging system comprises electromagnetic markers and sensors for collecting electromagnetic data.

11. The patient immobilizer of claim 9, wherein said imaging system comprises a pair of offset cameras for collecting optical data to noninvasively provide said 3D patient imaging data.

12. The patient immobilizer of claim 9, wherein said imaging system comprises one or more sensors for collecting radar data to noninvasively provide said 3D patient imaging data.

13. The patient immobilizer of claim 9, wherein said imaging system comprises a one or more sensors for collecting ultrasound data to noninvasively provide said 3D patient imaging data.

14. The patient immobilizer of claim 1, wherein said couch is comprised of head, torso, pelvic, thigh, calf and foot sections, each of said sections having at least one inflatable bladder on said base and at least one inflatable bladder on each of said side walls.

15. The patient immobilizer of claim 14, further comprising a position adjustable pillow in said head section to as to accommodate a patient's height.

16. The patient immobilizer of claim 14, wherein said thigh and calf sections can be angled so as to raise a patient's knees.

17. The patient immobilizer of claim 16, wherein said thigh and calf sections are adjustable so as to vary a height of said patient's knees.

18. A method of irradiating a patient with external beam therapy, said method comprising positioning a patient on the patient immobilizer of claim 14, compensating for a patient's movement in near real time, and irradiating said patient.

19. A method of irradiating a patient with external beam therapy, said method comprising positioning a patient on the patient immobilizer of claim 1, compensating for a patient's movement in near real time, and irradiating said patient.

20. The method of claim 19, wherein said patient position data is also used for beam shaping and positioning.

21. A patient immobilizer comprising:

a) a couch having a base, i) said base a plurality of inflatable bladders thereon;

ii) each of said inflatable bladders connected via lines to a fluid source;

iii) each of said lines having an independently actuatable valve;

b) a separate or integrated system for providing patient position data; and c) a processor for accepting said patient position data and for actuating said valves based on said patient position data so as to independently inflate or deflate one or more of said inflatable bladders, thus compensating for a patient's movement in near real time.

* * * * *